United States Patent [19]

Marchese et al.

[11] Patent Number: 4,793,557

[45] Date of Patent: Dec. 27, 1988

[54] FIREFIGHTING MONITOR APPARATUS

[76] Inventors: Antonio B. Marchese, 1020 NE. 8th Ave., Ocala, Fla. 32670; Timothy P. Ernst, 2677 NW. 20 St., Ocala, Fla. 32675

[21] Appl. No.: 610,375

[22] Filed: May 15, 1984

[51] Int. Cl.[4] ..... A62C 31/24

[52] U.S. Cl. ..... 239/587; 169/24

[58] Field of Search ..... 169/24, 25; 239/587

[56] References Cited

U.S. PATENT DOCUMENTS

| | | | |
|---|---|---|---|
| 1,644,972 | 10/1927 | Zeitter | 169/25 |
| 2,556,537 | 10/1947 | Harvey | 239/587 |
| 2,971,701 | 2/1961 | Shames et al. | 239/587 |
| 3,840,074 | 10/1974 | Clark | 239/587 |
| 4,119,152 | 10/1978 | Koyama | 169/25 |
| 4,195,692 | 4/1980 | Dion-Biro | 239/587 |

FOREIGN PATENT DOCUMENTS

| | | | |
|---|---|---|---|
| 324993 | 3/1919 | Fed. Rep. of Germany | 239/587 |
| 409155 | of 1910 | France | 239/587 |

*Primary Examiner*—Andreš Kashnikow

*Attorney, Agent, or Firm*—William M. Hobby, III

[57] ABSTRACT

A fire fighting monitor apparatus has a casing having at least one fluid inlet thereinto and a plurality of fluid outlets therefrom. The casing has a rotatable joint formed therein for rotating 360° all of the fluid outlets together. A circular ball joint swiveling nozzle is mounted on each fluid outlet for directing fluid for the outlet separately so that each nozzle can be separately controlled for direction and spray pattern for a plurality of water streams controlled by one fireman simultaneously. Each outlet can have dual swivels each rotating on a ball joint to provide greater flexibility in directing each nozzle. Outlets can also supply separate water hoses if desired. Additional reducing adapters are connected to nozzle outlets for using a variety of nozzle sizes.

11 Claims, 2 Drawing Sheets

FIG-1
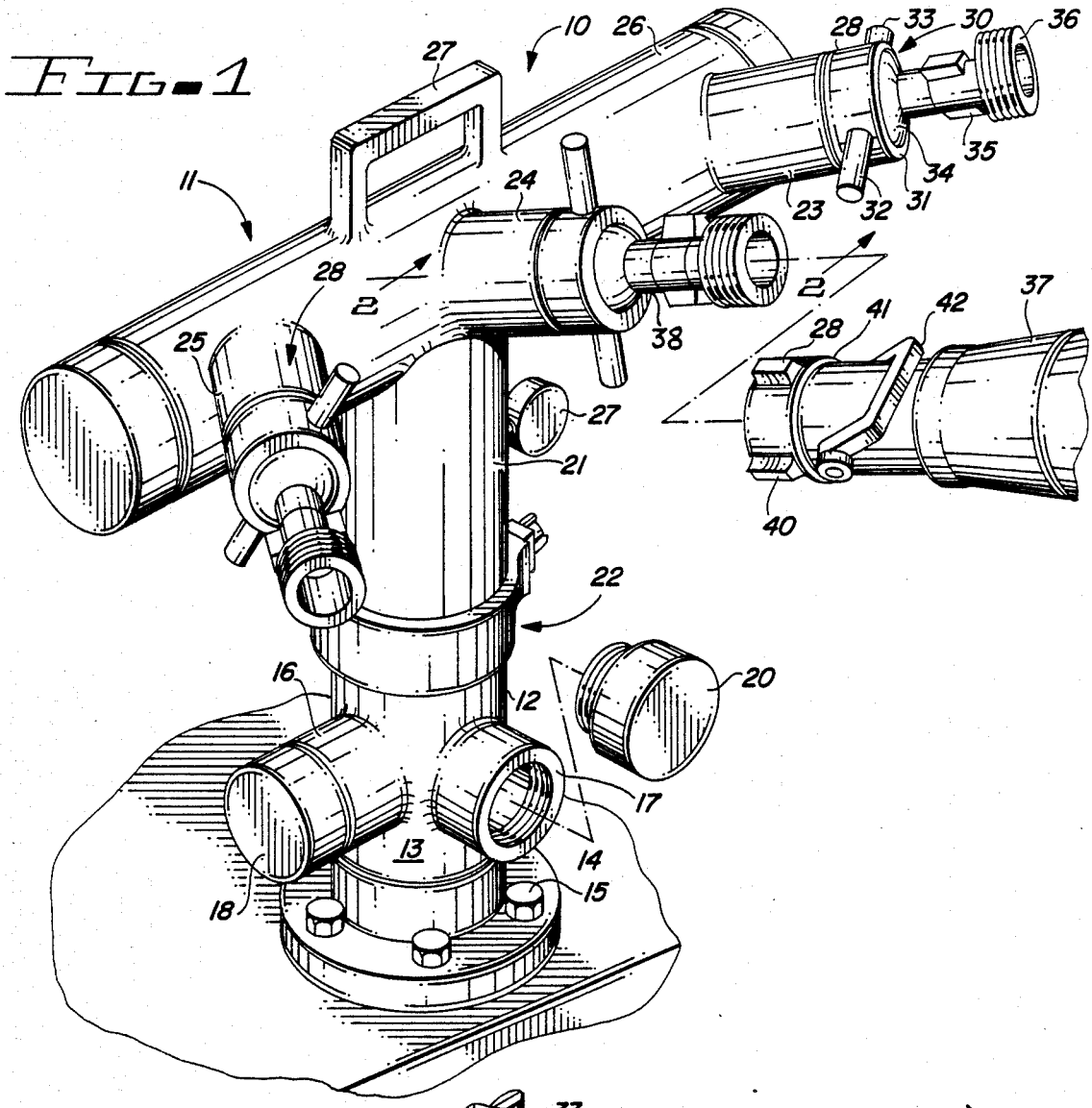
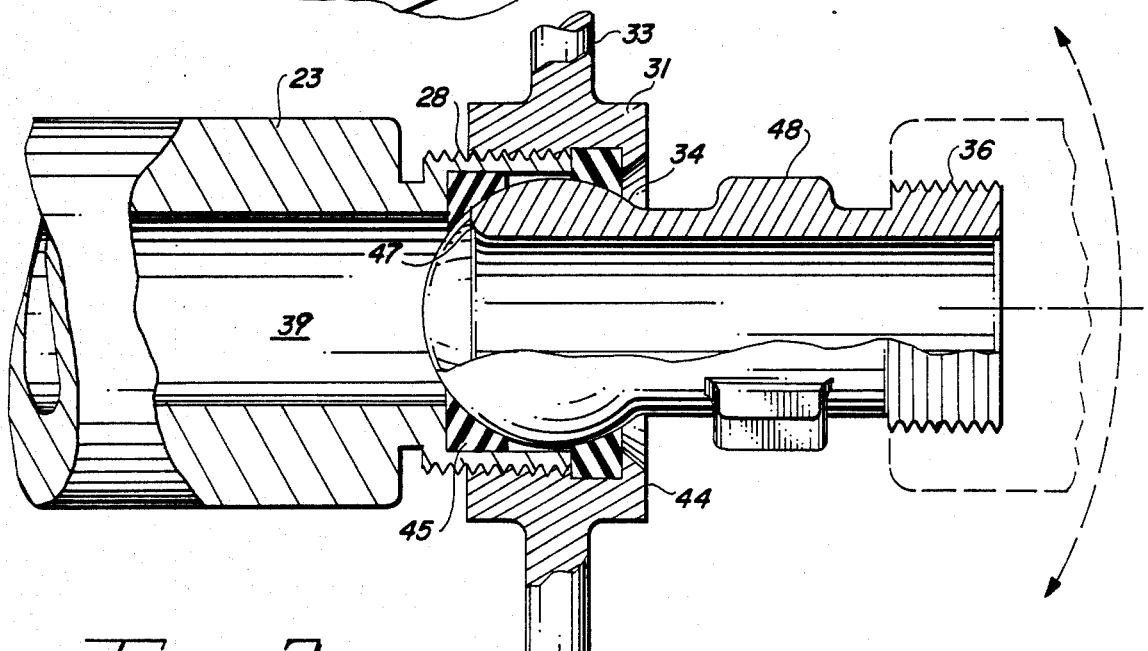
FIG-2

FIREFIGHTING MONITOR APPARATUS

BACKGROUND OF THE INVENTION

The present invention is directed towards a fire fighting monitor and especially to a monitor having a plurality of outlets and nozzles thereon which can direct a plurality of separate streams of fluid onto a fire.

In the past, a variety of monitors have been provided for use by firemen for controlling the flow of water onto a fire. Typical monitors are either permanently fixed on a fire truck. Other monitors are sometimes portable. All monitors provide for connection to a fire hydrant or other water source and then for directing the flow of water through a single outlet having a nozzle attached thereto for directing water onto a fire. Monitors provide for the rotation thereof to enable the directing the spray onto a fire. A typical monitor provides for rotating the monitor on its base through a 360° circle and then for moving the monitor through an up and down pattern so that the nozzle can be directed in any direction desired from the fire truck. In contrast to prior art monitors, the present invention is directed towards a monitor having plural outlets and nozzles, each one having a circular swivel joint to provide flexibility in directing each nozzle separately and also allowing each nozzle to have a separate dispersion control and all of which nozzles can be controlled by one fireman simultaneously while being directed at one or more separate fires.

Typical prior art nozzles for irrigation and for fire fighting can be seen in the following U.S. patents:

| | | |
|---|---|---|
| 119,987 | G. Bachstein | November 28, 1854 |
| 177,499 | J. Gerard, et al. | May 16, 1976 |
| 178,271 | J. Chadderton | June 6, 1876 |
| 255,430 | B. Holland, Jr. | March 28, 1882 |
| 610,926 | J. W. Suetterle | September 28, 1898 |
| 691,858 | M. H. Hart | January 28, 1902 |
| 804,807 | W. H. Glore | November 14, 1905 |
| 1,104,580 | A. Tregoning | July 21, 1914 |
| 1,241,572 | J. F. Stone | October 2, 1917 |
| 1,282,697 | E. Johnson | October 22, 1918 |
| 1,534,761 | J. B. Blaw | April 21, 1925 |
| 2,468,008 | H. W. Yocum | April 19, 1948 |
| 2,542,080 | W. J. Herrbold | February 20, 1951 |
| 3,810,582 | H. G. Lodge | May 14, 1974 |
| 3,826,431 | D. E. Telge | July 30, 1974 |
| 3,863,845 | J. G. Bumpstead | February 4, 1974 |
| 4,183,410 | G. Dion-Biro | January 15, 1980 |
| 4,209,282 | H. A. Eberhardt | June 24, 1980 |

In U.S. Pat. No. 4,183,410 to Dion-Biro, a fire fighting nozzle assembly having two discharged conduits is illustrated which can be rotated on its base and has two separately controlled discharge conduits. This differs from the present invention which contemplates three or more nozzles, each one mounted on a single or dual ball joint swivel from the same horizontal pipe so that a single fireman may rotate the monitor and control each nozzle separately as to direction and as to pattern of spray and as to which nozzle is turned on or off.

BRIEF DESCRIPTION OF THE DRAWINGS

Other objects, features and advantages of the present invention will be apparent from the written description and the drawings, in which:

FIG. 1 is a perspective view of a preferred embodiment of the present invention;

FIG. 2 is a sectional view taken on the line 2—2 of FIG. 1;

DESCRIPTION OF THE PREFERRED EMBODIMENTS

Figure 3:
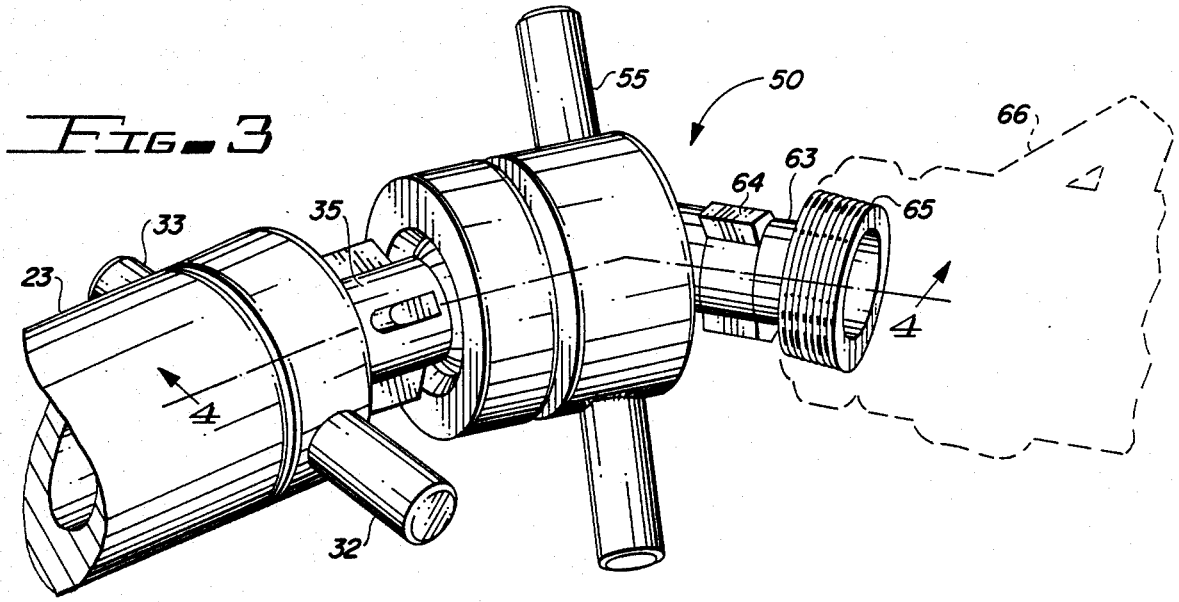
FIG. 3 is a perspective view of a double swivel nozzle for use on the monitor of FIG. 1.

Referring to the drawings and especially to FIG. 1, a fire fighting monitor 10 is shown having an upper casing 11 and a lower casing 12. The lower casing 12 is the inlet for the water from the fire hydrant or other water source which passes through the inlet pipe 13 having the flanged base 14 mounted with a plurality of bolts 15. The water enters from directly beneath the pipe 13 but additional water can be directed into the monitor through the inlets 16 and 17 mounted onto the side of the inlet pipe 12. Inlet 16 has a threaded cap 18 attached thereto while inlet 17 has a threaded cap 20 attached thereto for sealing the inlets when not in use. Removing the cap and attaching additional water lines can increase the pressure and flow of the water being fed through the monitor 10. The upper case portion 11 has a rotating pipe portion 21 connected by the rotary joint 22 which allows the pipe 21 and upper casing 11 to be rotated thereon for positioning a plurality of water outlets 23, 24 and 25 mounted on a horizontally extending water pipe 26. A pressure gauge 27 is mounted to the side of the water pipe. Each water outlet 23, 24 and 25 has a threaded end having a circular swiveling water discharge connection 30 attached thereto with an internally threaded collar 31 having handles 32 and 33 attached thereto. Each collar 31 has a ball 34 forming a ball joint in the collar 31 and a bore passes through the ball and through the next 35 extending from the ball. Neck 35 ends with a threaded connector portion 36 which will allow a specific nozzle 37 to be attached thereto with the internally threaded coupling. The coupling 38 has a plurality of dogs 40 thereon and is threaded with the internal thread portion 41 to the threads 36 and has a pivoting handle 42 attached thereto for supporting the nozzle portion 37. The outlets also allow for the attachment of individual hoses, if desired, or for the attachment of reducers for different size nozzles for each of the water outlets 23, 24 and 25.

In FIG. 2, the operation of the ball joint can be seen from the inlet 23 having the threaded portion 28 having the threaded collar 31 attached thereto. The handles 33 allow the collar 31 to be rotated. The outlet 23 has an internal passage 39, while the swivel attachment 30 has a ball 34 mounted in the collar 31, which collar has a pair of annular seals 44 and 45 mounted therein on either side of a center axis for the ball 34. This arrangement allows for a circular swiveling ball joint having a water passageway 46 therethrough with the internal end of the bore 46 having an annular radius surface 47. A plurality of dogs 48 allow the gripping of this portion of the swivel joint, while the threaded portion 36 allows the attachment of individual nozzles or a second circular swivel joint, as shown in FIGS. 3 and 4.

Figure 4:
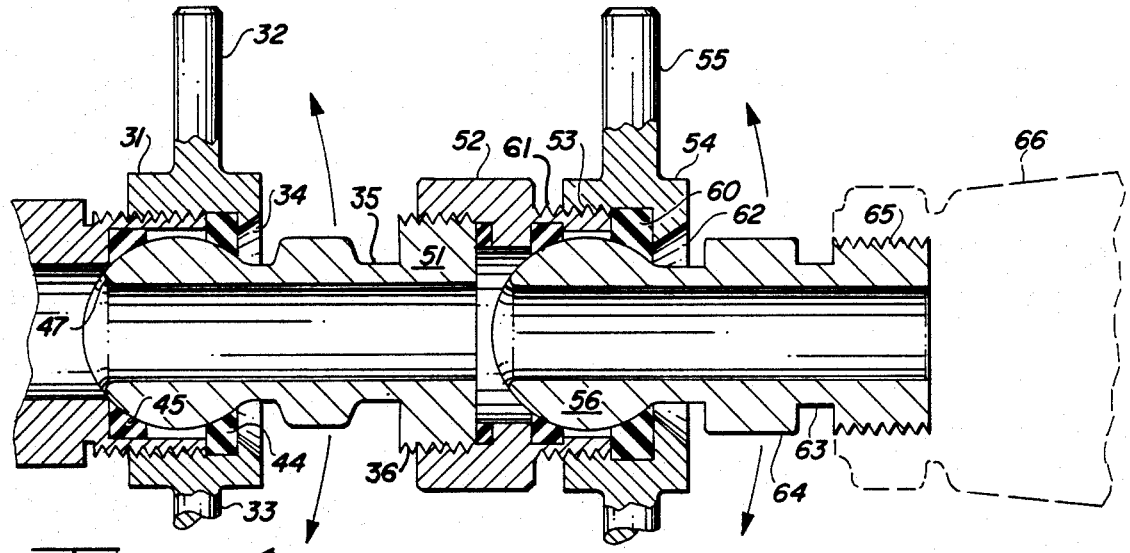
FIG. 4 is a sectional view taken on the line 4—4 of FIG. 3.

Turning to FIGS. 3 and 4, a dual 360° circular swiveling nozzle coupling 50 for the outlets 23, 24 and 25 is illustrated having connected to the outlet 23 with the collar 31 and handles 32 and 33 in accordance with FIGS. 1 and 2. The pipe 35 has a threaded end 36 connected to an internal threaded connector 51 in coupling pipe 52. Coupling member 52 also has an externally threaded portion 53. The externally threaded portion 53 has a collar 54 threaded thereon using handles 55 for holding a second ball 56 therein to provide a pair of swivel joints on the same coupling. Ball 56 has a fluid passageway therethrough having an annular radius opening and a pair of annular seals 60 and 61 similar to the swiveling ball joints 30 having the ball 34 held by the collar 31. The collar 54 has an annular cone shaped opening 62 for the passage of the coupling pipe section 63 having gripping knobs 64 thereon. The pipe section 63 has an externally threaded portion 65 for connecting a nozzle 66 thereto.

It will be clear that the coupling portion shown in FIGS. 3 and 4 adds an additional ball joint swivel to the one already shown on outlets 23, 24 and 25 of FIG. 1. The dual 360° circular ball joints give a greater degree of swivel and a more universal motion to the outlet for directing the nozzles with greater flexibility. The handles 55 and 32 and 33 allow a fireman to loosen the collar 31 and 54 for a rapid movement of the swiveling coupling 50 and then to lock the collars to position a nozzle in a fixed position. This is rapidly accomplished by the fireman for each individual nozzle so that each can be directed as desired and each can have a different nozzle for directing a different pattern of water at the same or a different direction, or at the same fire or at different fires simultaneously. This flexibility is combined with the rotating joint 22 of FIG. 1 which allows all three outlets to be rotated simultaneously, while the dual swivel portions of FIGS. 3 and 4 allow each nozzle to be swiveled in any direction rather than just in an up and down direction, as is common with single or dual nozzle monitors. The ball joints allow for circular swiveling in any direction while the radiused surfaces to the bore opening reduces the friction of the passing fluid.

Figure 5:
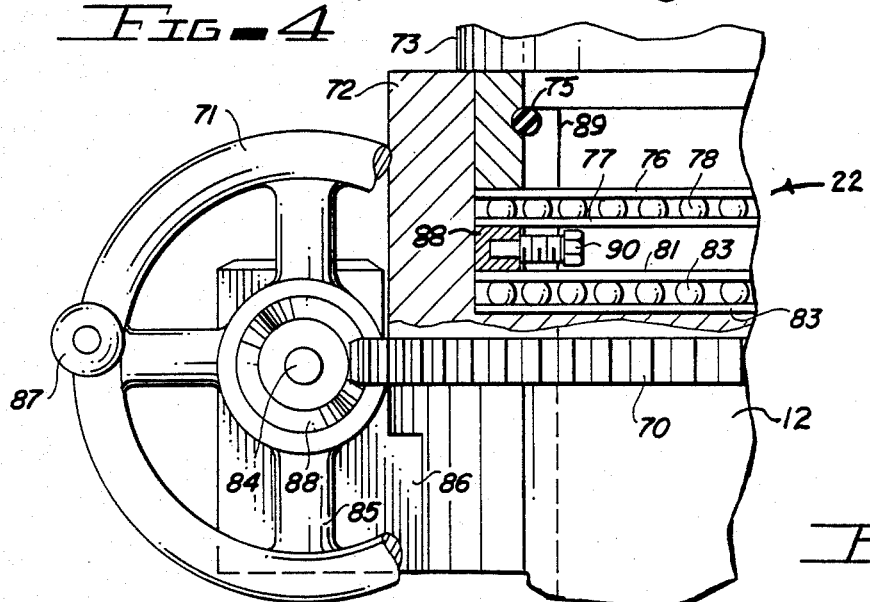
FIG. 5 is a sectional view of the rotating joint mechanism.

As shown in FIG. 5, the rotating joint 22 includes an outer rotating collar 72 having an annular gear rack 70 fixedly attached thereto and operatively engaged by a pinion gear 88 which rotates with the shaft 84 when the round handle 71 is turned. Handle 71 may be turned by gripping the handle 87 to rotate the handle 71. The handle rotates on a gear box 86 which rotates the pinion 88 with the handles 71 connected by spokes 85 to the shaft and gear box. The gear box 86 is connected to the lower tube 12 and rotates the collar 72 when the handle 71 is rotated by driving the gear 70. The upper water pipe 73 is fixedly attached to the collar 72 such as by welding or may be attached by threads if desired. A plurality of retaining ring screws 90 pass through the wall 89 of the lower tube 12 and lock into the retaining ring 88, which is located between a pair of ball bearing assemblies. The upper ball bearing assembly has a stainless steel upper bearing retaining ring 76 and a stainless steel lower ball bearing retaining ring 77 and a plurality of teflon balls 78 therebetween. The lower bearing assembly has a stainless steel retaining ring 81, a plurality of teflon ball bearings 83 and a lower stainless steel retaining ring 83. The lower ball bearing retaining ring assist in balancing the water pressure passing through the pipe 12 while the upper ball bearing assembly supports the collar 72 and upper pipe 73 during rotation. A sealing O-ring 75 mounts between the top edge of the wall 89 and the wall of the pipe 73. The retaining ring 88 is supported on the wall 89 by the retaining ring screws 90 so that the pipe 73 and collar 72 are supported on the bearing assembly riding on the retaining ring 88. The rotating assembly illustrated here is only one of any number of sealed rotating joints that can be utilized without departing from the scope of the invention.

It should be clear at this point that a universal and multiple fire truck monitor has been illustrated which allows flexible control of a plurality of individual nozzles from a single monitor having a single or plural inlets thereto. Great flexibility is provided by the rotation of all nozzles simultaneously and then by the dual swivel connection for each nozzle and the use of individual nozzles having different flow capacities, if desired, so that a fire can be flooded with a heavy stream or mist while simultaneously directing liquid directly on a fire. In practice, the monitor has been shown to be easily operated by a single fireman who can operate the individual swivel joints rapidly as liquid is being directed through them. They can then be locked in place until the fireman is ready to change the direction or position of the liquid.

Accordingly, the present invention is not to be construed as limited to the forms shown, which are to be considered illustrative rather than restrictive.

I claim:

1. A fire fighting monitor comprising in combination:

a casing having at least one fluid inlet thereinto and a plurality of outlet therefrom;

rotary joint means formed on said casing for rotating said fluid outlets together; and a swiveling nozzle coupling coupled with dual swiveled ball joint couplings to each fluid outlet for directing fluid from each outlet separately for each nozzle, each nozzle being separately controlled for direction in spray pattern and each ball joint having a passageway therethrough having an annular radius surface thereon and attached to the outlet with an attaching collar having internal threads therein for locking said ball joint in position by rotating said collar whereby a fire fighting monitor allows separate fluid streams of controlled fluid dispersion patterns.

2. A fire fighting monitor in accordance with claim 1, in which said casing has a plurality of liquid inlets.

3. A fire fighting monitor in accordance with claim 2, in which each locking collar has a pair of annular seals therein for locking against said ball joint rotatably mounted therein.

4. A fire fighting monitor in accordance with claim 3, in which each said swiveling coupling has a collar having at least one handle attached thereto for hand rotation of said collar to lock said ball joint in position.

5. A fire fighting monitor in accordance with claim 4, in which said rotary joint means has a pair of rotating bearings having stainless steel bearing retainers positioned on either side of teflon ball bearings.

6. A fire fighting monitor in accordance with claim 5, in which said rotary joint includes a locking collar and a swivel ring.

7. A fire fighting monitor in accordance with claim 6, in which said rotary joint means includes an annular gear engaging a drive pinion which is driven by a rotating handle.

8. A fire fighting monitor in accordance with claim 1, in which said casing has a handle formed thereon for lifting and moving said monitor.

9. A fire fighting monitor in accordance with claim 1, in which each swiveling coupling has attaching means for attaching a nozzle thereto.

10. A fire fighting monitor in accordance with claim 9 in which said casing has a flanged bottom for attaching to a fire truck surface.

11. A fire fighting monitor in accordance with claim 9 in which each swivel has an adapter for reducing the size of a nozzle attached thereto.

* * * * *